US005419140A

United States Patent [19]

Germain

[11] Patent Number: 5,419,140

[45] Date of Patent: May 30, 1995

[54] DEVICE FOR RECYCLING A CRYOGENIC LIQUID AND ITS USE IN AN APPARATUS FOR FREEZING PRODUCTS

[75] Inventor: Jean-Pierre Germain, Montigny Les Bretonneux, France

[73] Assignee: L'Air Liquide, Societe Anonyme Pour L'Etude Et L'Exploitation Des Procedes Georges Claude, Paris, France

[21] Appl. No.: 213,572

[22] Filed: Mar. 16, 1994

[30] Foreign Application Priority Data

Mar. 26, 1993 [FR] France ..... 93 03480

[51] Int. Cl.[6] ..... F17C 13/02; F25D 17/02

[52] U.S. Cl. ..... 62/49.2; 62/64; 62/375; 62/376

[58] Field of Search ..... 62/49.1, 49.2, 50.1, 62/50.4, 375, 376, 64

[56] References Cited

U.S. PATENT DOCUMENTS

| | | | |
|---|---|---|---|
| 2,959,034 | 11/1960 | Morrison | 62/376 |
| 3,007,319 | 11/1961 | Ogden | 62/376 X |
| 3,049,887 | 8/1962 | Sharp et al. | 62/49.2 |
| 3,368,363 | 2/1968 | Alaburda et al. . | |
| 3,537,271 | 11/1970 | Montag | 62/49.2 |
| 3,600,901 | 8/1971 | Wagner . | |
| 3,605,427 | 9/1971 | Rudy | 62/375 X |
| 3,611,737 | 10/1971 | Alaburda et al. . | |
| 3,733,847 | 5/1973 | Powell | 62/375 |
| 3,768,272 | 10/1973 | Barrett . | |
| 3,882,687 | 5/1975 | Asztalos et al. | 62/64 |
| 4,165,618 | 8/1979 | Tyree, Jr. | 62/64 |
| 4,744,222 | 5/1988 | Murai | 62/49.2 |

FOREIGN PATENT DOCUMENTS

| | | | |
|---|---|---|---|
| 0505222 | 9/1992 | European Pat. Off. . | |
| 2068584 | 8/1971 | France . | |
| 2352147 | 4/1975 | Germany . | |
| 4107320 | 9/1992 | Germany | 62/50.4 |
| 9103679 | 3/1991 | WIPO | 62/49.2 |

*Primary Examiner*—Christopher Kilner
*Attorney, Agent, or Firm*—Young & Thompson

[57] ABSTRACT

A device for recycling a cryogenic liquid in a circuit (1) comprising at least one section (2) substantially at ambient pressure, the device comprising: a) a first cryogenic reservoir (4) to recover the liquid at the outlet of the section, this reservoir being provided with structure ($4_3$, $6_1$, $7_1$, $8_1$) to pressurize the recovered liquid, b) a second cryogenic reservoir (5) continuously pressurized in operation and connected to the circuit (1) upstream of the section (2) open to the air to supply it with pressurized cryogenic liquid, the second reservoir being in selective fluid communication (16) with the first reservoir, and c) a device (12) responsive to a predetermined relationship of the levels of filling of the two reservoirs selectively to actuate the pressurization structure ($4_3$, $6_1$, $7_1$, $8_1$) of the first reservoir (4) so as to transfer into the second reservoir (5) cryogenic liquid contained in the first reservoir.

6 Claims, 1 Drawing Sheet

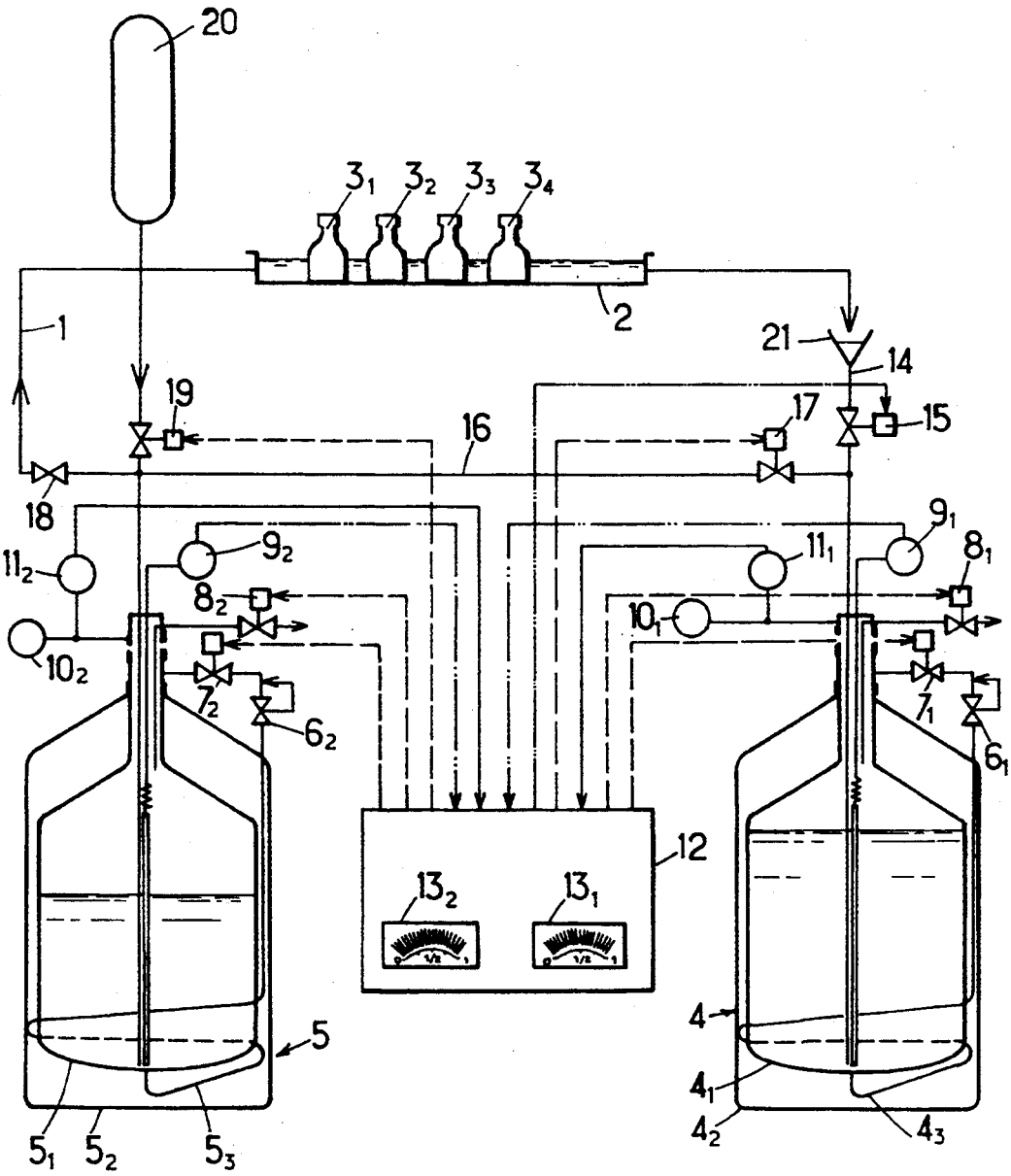
20
$3_1$ $3_2$ $3_3$ $3_4$
2
1
21
14
19
17
15
16
18
$9_1$
$9_2$
$11_1$
$11_2$
$8_1$
$8_2$
$10_1$
$10_2$
$7_1$
$7_2$
$6_1$
$6_2$
12
$13_1$
$13_2$
4
$4_1$
$4_2$
$4_3$
5
$5_1$ $5_2$ $5_3$

DEVICE FOR RECYCLING A CRYOGENIC LIQUID AND ITS USE IN AN APPARATUS FOR FREEZING PRODUCTS

The present invention relates to a device for recycling a cryogenic liquid and, more particularly, to such a device conceived to supply a circuit comprising at least one section substantially at ambient pressure, typically in the open air, such as is found in the use of the invention for freezing food, pharmaceutical or veterinary products.

There has recently been proposed the freezing of products, particularly food products, arranging the products in a current of liquid nitrogen, within a so-called "crusting" tunnel in which liquid nitrogen circulates at atmospheric pressure. The circulation of the liquid nitrogen in the tunnel and its recycling in the supply circuit of this latter are ensured by pumps. A freezing device of this type is known from the patent EP-A-505.222.

The movement of the liquid nitrogen in the pumps is not without its drawbacks. Thus, various particles, of joints for example, or of oil droplets can detach from the pumps and thus pollute the liquid nitrogen. Such pollution is considered as unacceptable in the case of freezing certain products, particularly pharmaceutical products. The object of the present invention, therefore, is to produce a device for recycling a cryogenic liquid in a circuit, which will not rely on pumps to ensure the circulation of the liquid in the circuit and which gives rise to no pollution of this liquid.

The present invention also has for its object to provide such a device which will be adapted to supply a circuit comprising a section substantially at atmospheric pressure such as a freezing tunnel for products in which the latter are immersed in a current of cryogenic liquid.

These objects of the invention are achieved, as well as others which will become apparent from a reading of the description which follows, by a recycling device of the above type comprising a) a first cryogenic reservoir to recover said liquid at the outlet of said section, this reservoir being provided with means to pressurize the recovered liquid, b) a second cryogenic reservoir continuously pressurized in operation and connected to the circuit upstream of said section to supply it with pressurized cryogenic liquid, this second reservoir being selectively in fluid communication with the first reservoir, and c) means responsive to a predetermined relationship in the levels of filling of the two reservoirs to activate selectively the pressurization means of the first reservoir so as to transfer into the second reservoir cryogenic liquid contained in the first reservoir.

Thanks to the liquid transfer thus effected between the first and second reservoirs, this latter can supply the circuit with recycled and repressurized liquid, which ensures the circulation of the liquid without pumps, and hence without pollution.

The present invention also relates to a simple and reliable apparatus for freezing products, comprising at least one device such as defined above.

Other characteristics and advantages of the present invention will become apparent from a reading of the description which follows, and a study of the accompanying drawing, in which the single figure shows schematically the arrangement of the device according to the invention.

Solely by way of example, the device of FIG. 1 serves to supply, with a cryogenic liquid such as liquid nitrogen, a circuit 1 passing through a vat 2 in which are immersed bottles $3_1$, $3_2$, $3_3$, etc . . . containing food, pharmaceutical or veterinary products to be frozen, for example. The device comprises essentially first and second reservoirs of cryogenic liquid 4 and 5, respectively, each comprising a conventional double walled receptacle $4_1$, $4_2$, and $5_1$, $5_2$, respectively. Each receptacle 4, 5 is provided also with internal pressurization means comprising a serpentine $4_3$, $5_3$, respectively, installed conventionally between the bottom of the wall $4_1$, $5_1$ and the closed neck of this same wall.

On each serpentine $4_3$, $5_3$ is located in series a pressure regulation valve $6_1$, $6_2$ and an electrovalve $7_1$, $7_2$, respectively. The reservoirs 4, 5 are also provided with electrovalves for communication with the ambient air $8_1$, $8_2$, of liquid level detectors $9_1$, $9_2$, with manometers $10_1$, $10_2$ and with pressostats $11_1$, $11_2$, respectively. All the electrovalves are controlled by the electronic means contained in a control panel 12 which receives the signal supplied by the pressostats and the level detectors $9_1$, $9_2$, the levels in the reservoirs 4, 5 being adapted to be displayed on the panel at $13_1$, $13_2$, respectively. The level detectors can be of conventional type, a rod type, or of the type described in the patent application EP-A-530.102.

The reservoir 4 recovers, by a funnel 21 and a conduit 14 provided with an electrovalve 15 also controlled by the panel 12, liquid nitrogen at atmospheric pressure which leaves the freezing vat 2. The nitrogen thus recovered can, under the conditions which will be described later, be returned to the reservoir 5, via a conduit 16 provided with an electrovalve 17 controlled by the electronic means contained in the panel 12.

The reservoir 5 serves to supply the circuit 1, via a valve 18 which can be manually controlled. The reservoir is itself supplied, according to the present invention, either by an external source 20, through an electrovalve 19, or by the reservoir 4, as will be described below in the description of the operation of the device according to the invention. Preliminarily, it will be noted that the electrovalves:

$7_1$, 17, $8_2$, 19 are normally closed $8_1$, 15, $7_2$ are normally open Moreover, the pressostat $11_1$ emits a signal when the pressure in the reservoir 4 reaches a predetermined level permitting the transfer of nitrogen under pressure toward the reservoir 5. The pressostat $11_2$ serves continuously to regulate the pressure in the reservoir 5, at another predetermined level. To do this, the pressostat emits "high" and "low" signals representative of pressures bracketing this predetermined level.

Before placing the device according to the invention in service, the reservoir 5 is filled which will distribute nitrogen to the circuit 1. To do this, the electronic control means power the electrovalves 19 and $8_2$ (communicating with the ambient air) which are normally closed and which thus open, as well as the normally open electrovalve $7_2$ which then closes. The other reservoir 4 must at this moment be inactive, and, to do this, the electrovalves 17, 15, $7_1$ and $8_1$ are maintained unpowered.

The external source 20 of nitrogen under pressure, at 1.5 to 2 bars, for example, then empties into the reservoir 5 through the open electrovalve 19, until the level detector $9_2$ indicates to the electronic means contained in the panel 12 that the maximum level of filling of the reservoir 5 is achieved.

These electronic means (not shown) can be easily assembled from the description of the various modes of operation of the device according to the invention which will now be described. They are instructed as to the condition of the device by the level detectors $9_1$, $9_2$ and the pressostats $11_1$, $11_2$ and react to the signals received from these means by controlling the opening or closing of the various electrovalves, as indicated below.

The reservoir 5 being filled, it is possible to place the device in operation with liquid nitrogen flowing in the circuit 1 containing the same. To do this, valve 18 is opened and the control means power or maintain powered the electrovalves $8_1$, $7_1$, 15, 17 on the one hand and the electrovalves $7_2$, $8_2$ and 19 on the other hand. The electrovalves $7_2$ being then open and the electrovalve $8_2$ communicating with the ambient air being closed, liquid withdrawn from the bottom of reservoir 5 by the serpentine $5_3$ vaporizes and enters the reservoir 5 above the surface of the liquid nitrogen. The vapor pressure thus established in the reservoir 5 is limited by the pressure of regulator $6_2$, to a pressure of for example 1.1 bar. When the pressure in the reservoir exceeds the upper level of the pressostat $11_2$, the control means open the electrovalve $8_2$ to reduce the pressure to the predetermined level.

Thanks to this slight overpressure relative to atmospheric, the liquid nitrogen contained in the reservoir 5 is forced into the circuit 1, through the valve 18. The nitrogen distributes itself in the circuit and bathes the products disposed in the vat 2. In this vat, at atmospheric pressure, a portion of the liquid vaporizes and disperses in the atmosphere. The unvaporized portion flows to a funnel 21 connected to a line 14 and passes through the normally open electrovalve 15 to the reservoir 4 for recovery, which thus progressively fills while the reservoir 5 empties.

This process continues until the level of nitrogen in the reservoir 5 falls to a predetermined low level, corresponding for example to a quarter of the maximum content of the reservoir. Liquid nitrogen must thus remain permanently in the reservoir so as to prevent the latter from reheating. Upon receipt of a signal emitted by the level detector $9_2$ and representing the fact that the level of nitrogen in the reservoir has achieved said low level, the control means control the level of liquid in the reservoir 4. If this latter is above a predetermined low level, corresponding here also and for the same reasons, for example to a quarter of the maximum content of the reservoir 4, the control means trigger a pressurization of this reservoir by opening the electrovalves $7_1$ and by closing the electrovalve $8_1$ communicating with the open air. Liquid removed by the serpentine $4_3$ from the bottom of the reservoir 4 is then vaporized and the vapor pressure above the liquid increases to a value fixed by the pressure regulator $6_1$, to a value slightly greater than the reference value (1.1 bar) fixed for the pressure in the reservoir 5, namely 1.2 bar for example. The pressostat $11_1$ signals this pressure level to the control means.

It will be noted in this connection that, according to the invention, the pressure in the reservoir 5 is constantly maintained at a value greater than atmospheric pressure but that this is not the case in reservoir 4 in which the electrovalve $8_1$ for communication with ambient air is normally open to permit the filling of the reservoir 4 by nitrogen at atmospheric pressure recovered from the outlet of vat 2.

When the pressure in reservoir 4 achieves the fixed reference value, the control means of the device according to the invention triggers the opening of the electrovalve 17 and the closing of the electrovalve 15. A current of liquid nitrogen then leaves the reservoir 4 to refill the reservoir 5 which, according to the supposition stated above, has then achieved its low level. The level of nitrogen in the reservoir 5 increases continuously to the maximum filling level of this reservoir or, according to the invention, until the level of the nitrogen in the reservoir 4 reaches its low level. In this latter case, the control means close the electrovalve 17 to prevent the reservoir 4 from emptying excessively. There will then be a reopening of the electrovalves 14 and $8_1$ to permit the reservoir 4 to fill again.

If at the moment of closing of the electrovalve 17, the reservoir 5 is not filled, there will be an opening of the electrovalve 19 to complete the filling of the reservoir 5 with the liquid nitrogen from the external source 20. This liquid can then also enter directly into the circuit 1, the valve 18 then being open. It will be noted in this connection that the reservoir 20 also serves to recharge the circuit in a manner to compensate losses by evaporation of liquid nitrogen in the vat 2.

The process described above repeats periodically so that the reservoir 5 will constantly be filled with a sufficient quantity of liquid nitrogen under pressure, suitable to supply the circuit 1 with a substantially constant flow rate. Thus, the electronic control means triggers selectively transfers of liquid nitrogen from the reservoir 4 to the reservoir 5, from the source 20 to this reservoir, and the supply of the reservoir 4 from the outlet of circuit 1 so as to maintain the predetermined relationships between the levels of liquid nitrogen in the two reservoirs, these relationships being necessary to ensure a supply without interruption of the circuit 1 and the recycling of the nitrogen circulating in this circuit.

It will now be apparent that the invention permits achieving the initially recited objects, namely: to ensure a circulation of a current of liquid nitrogen without pumping and hence without pollution. The device according to the invention is thus particularly well adapted to the freezing of pharmaceutical products subjected to particularly severe standards of cleanliness.

Of course the invention is not limited to the embodiment described and shown which has been given only by way of example. Other cryogenic products such as liquid argon could be used and other uses envisaged, i.e. controlling the temperature of a gas such as air, etc.

What is claimed is:

1. A device for recycling a cryogenic liquid in a circuit (1) comprising at least one section (2) substantially at ambient pressure, the device comprising:

a) a first cryogenic reservoir (4) to recover said liquid at the outlet of said section, said reservoir being provided with means ($4_3$, $6_1$, $7_1$, $8_1$) to pressurize the recovered liquid, b) a second cryogenic reservoir (5) continuously pressurized in operation and connected to the circuit (1) upstream of said section (2) to supply said section (2) with pressurized cryogenic liquid, the second reservoir being in selective fluid communication (16) with the first reservoir, and c) means (12) responsive to a predetermined relationship of the levels of filling of the two reservoirs selectively to actuate the pressurization means ($4_3$, $6_1$, $7_1$, $8_1$) of the first reservoir (4) so as to transfer into the second reservoir (5) cryogenic liquid contained in the first reservoir.

2. A device according to claim 1, wherein the second reservoir (5) is selectively connectible to an external source (20) of cryogenic liquid, said means (12) responsive to a predetermined relationship of the filling levels of the two reservoirs selectively controlling the supply of the second reservoir (5) from said source (20) when the level of the liquid in the first reservoir reaches a predetermined low level.

3. A device according to claim 1, wherein said means (12) responsive to a predetermined relationship of the filling levels of the two reservoirs control the emptying of the first reservoir (4) into the second reservoir (5) until a predetermined maximum level is reached in the second reservoir (5), or a predetermined minimum level is reached in the first reservoir (4).

4. A device according to claim 1, wherein at least one of the reservoirs (4, 5) is provided with internal pressurization means.

5. A device according to claim 1, wherein the cryogenic liquid is liquid nitrogen.

6. Freezing apparatus, comprising a section (1) for moving products comprising an outlet for cryogenic liquid, and which further comprises a device according to claim 1.

* * * * *